United States Patent [19]

Bergmann et al.

[11] Patent Number: 4,991,241

[45] Date of Patent: Feb. 12, 1991

[54] COMBINATION SANITARYWARE AND FITTING

[75] Inventors: Konrad Bergmann, Wittlich, Fed. Rep. of Germany; Axel Enthoven, Wijnegen, Belgium

[73] Assignee: Americand Standard Inc., New York, N.Y.

[21] Appl. No.: 437,865

[22] Filed: Nov. 16, 1989

Related U.S. Application Data

[63] Continuation of Ser. No. 177,553, Apr. 1, 1988.

[30] Foreign Application Priority Data

Jul. 29, 1987 [AT] Austria ..... 1923/87
Jul. 29, 1987 [AT] Austria ..... 1924/87

[51] Int. Cl.[5] ..... A47K 1/04
[52] U.S. Cl. ..... 4/619; 4/192
[58] Field of Search ..... 4/619, 650, 651, 653

[56] References Cited

U.S. PATENT DOCUMENTS

| | | | |
|---|---|---|---|
| 921,574 | 5/1905 | Weaver | 4/651 X |
| 1,020,324 | 3/1912 | Stephenson | 4/653 |
| 1,290,736 | 1/1919 | Greenberg | 4/650 X |
| 1,426,046 | 8/1922 | Cohen | 4/651 X |
| 2,191,453 | 2/1940 | Corbin | 4/651 |
| 4,765,002 | 8/1988 | Platner | 4/619 |

*Primary Examiner*—Charles E. Phillips
*Attorney, Agent, or Firm*—Blum Kaplan

[57] ABSTRACT

A sanitary fitting and plumbing fixture, such as a sink, bathtub or lavatory, are so arranged such that the actuating lever and spout are disposed in recesses formed in the plumbing fitting, the spout being constructed so that when water is flowing through the fitting, it is discharged from the spout in a waterfall-like fashion.

4 Claims, 7 Drawing Sheets

COMBINATION SANITARYWARE AND FITTING

REFERENCE TO PRIOR APPLICATION

This application is a continuation of U.S. patent application Ser. No. 07/177,553 filed Apr. 1, 1988 for "Combination Sanitaryware And Fitting", now abandoned.

BACKGROUND OF THE DISCLOSURE

1. Field of the Invention

The invention concerns an integrated plumbing fixture and fitting having a spout that is straight or curved in its cross section and which provides relatively wide, film-like water jets in the form of a waterfall.

2. Description of Prior Art

Previously known waterfall-type spouts are formed having a cross section that remains uniform in the flow direction. The disadvantage of such a design is that the water jet is constricted after leaving its outlet so that its surface tension tends to return the water jet to a cylindrical jet. The results of such previous designs are that film-like water jets produced are unsatisfactory.

With the usual bathroom arrangements, the sink or the bathtub and the sanitary fitting are separated from one another, where the spout either is fastened to a wall or is fastened on the sink or on a section of the bathtub and therefore protrudes from it. For some time, a possibility has been sought to avoid such a protruding outlet.

SUMMARY OF THE INVENTION

An object of the present invention is to provide a bathtub or sink arrangement having an integrated sanitary fitting where its water outlet, spout, does not protrude and is generally not visible when viewing the bathtub or sink.

Another object of the invention is to provide a spout which has a cross section that increases in width in the direction of water flow, thereby preventing constriction of the film-like water jets.

Still another object of the invention is to provide a spout in which the cross section spout decreases in height in the flow direction so that the flow rate of water through the spout remains constant despite the increase in width of the spout in the direction of flow.

A further object of the invention is to overcome the disadvantages heretofore encountered and to provide a spout of the waterfall type, which is inexpensive to manufacture and which has a very simple structure.

The invention generally contemplates providing, in bathtubs, sinks or the like, a water outlet or spout which is integrated with a sanitary fitting. Also, the water spout is designed to discharge water in waterfall-like fashion. The water discharged from a wall of the sanitaryware, such as a bathtub, sink or the like, is generally in the form of a straight or curved curtain or a filmy gush, and is distributed over a wide area at the bottom of the sanitaryware. Further, such a spout arrangement is space-saving since the integrated water spout is designed generally flat according to the type of waterfall spout of the present invention.

BRIEF DESCRIPTION OF THE DRAWINGS

The invention will now be described in more detail, by way of example, in terms of the drawings.

DETAILED DESCRIPTION OF THE PREFERRED EMBODIMENT

Figure 1:
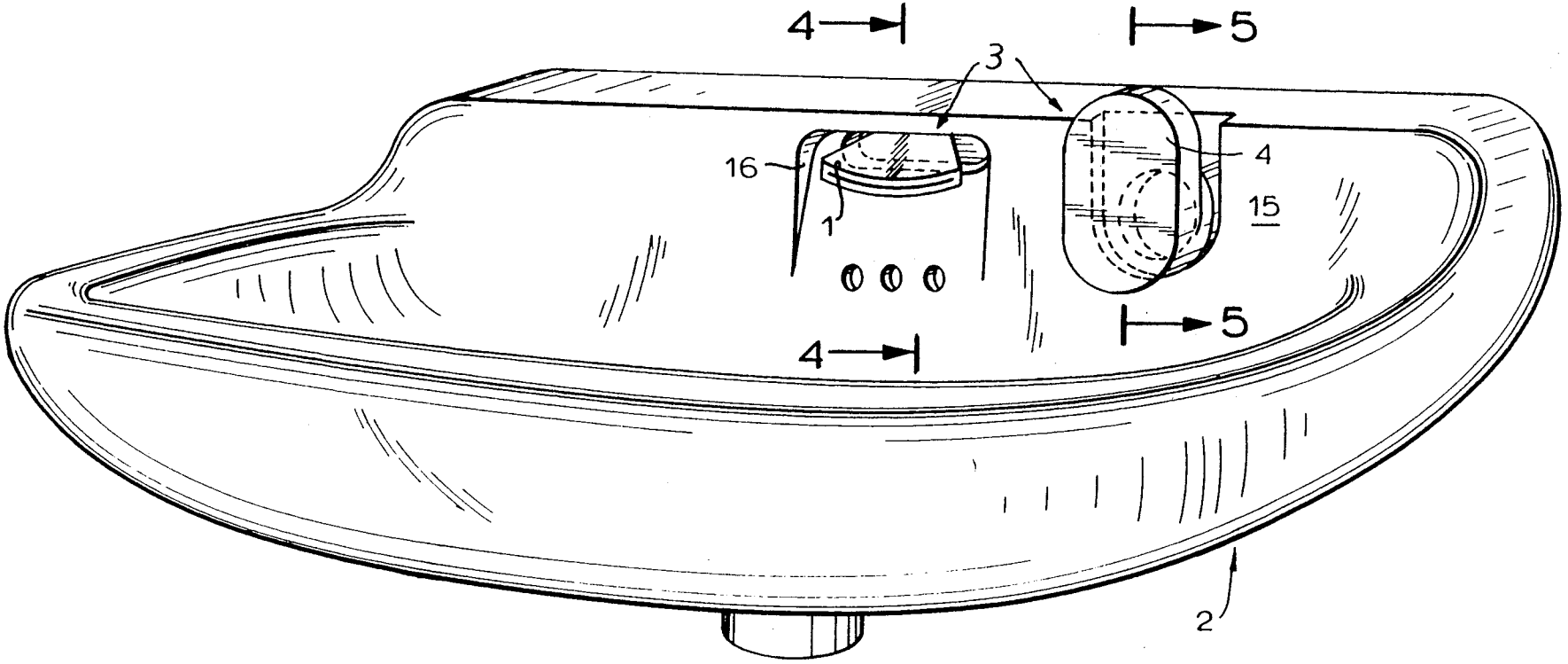
FIG. 1 is a perspective view of an integrated lavatory and sanitary fitting illustrating the waterfall pattern discharged from the spout, in accordance with the present invention.
Figure 2:
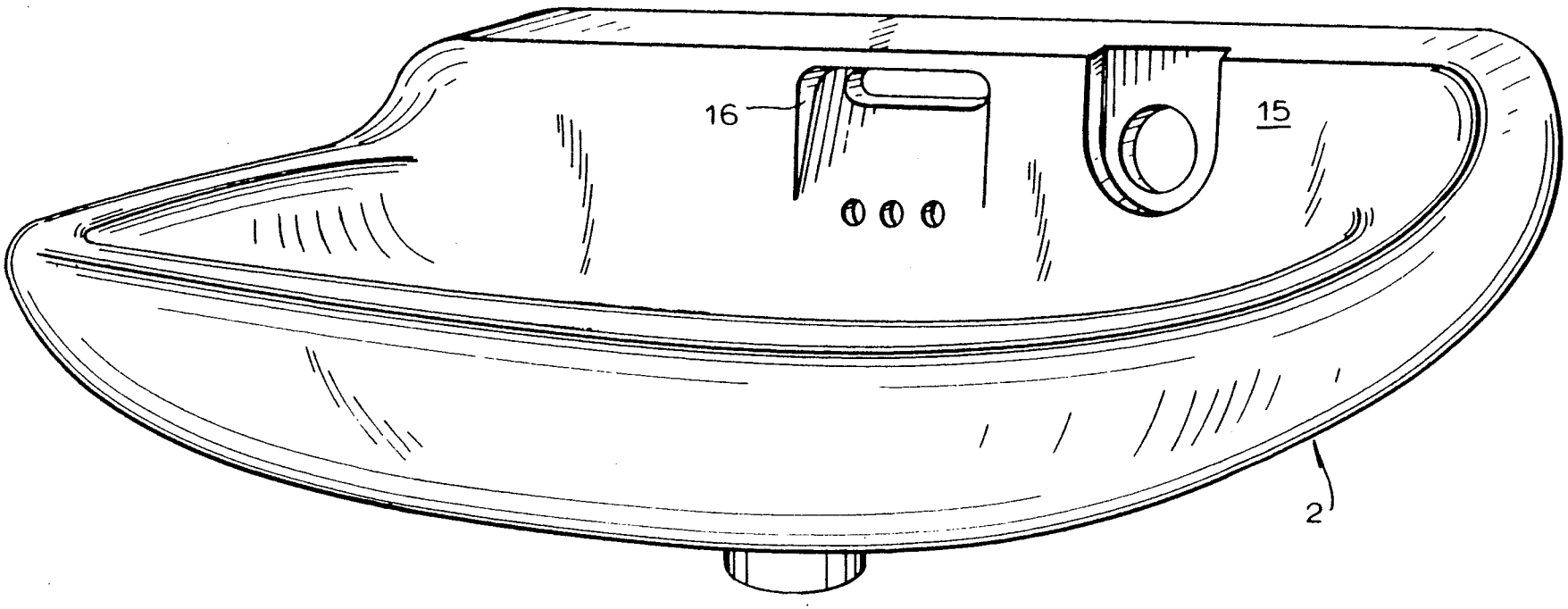
FIG. 2 is a perspective view of the sanitaryware only.
Figure 3:
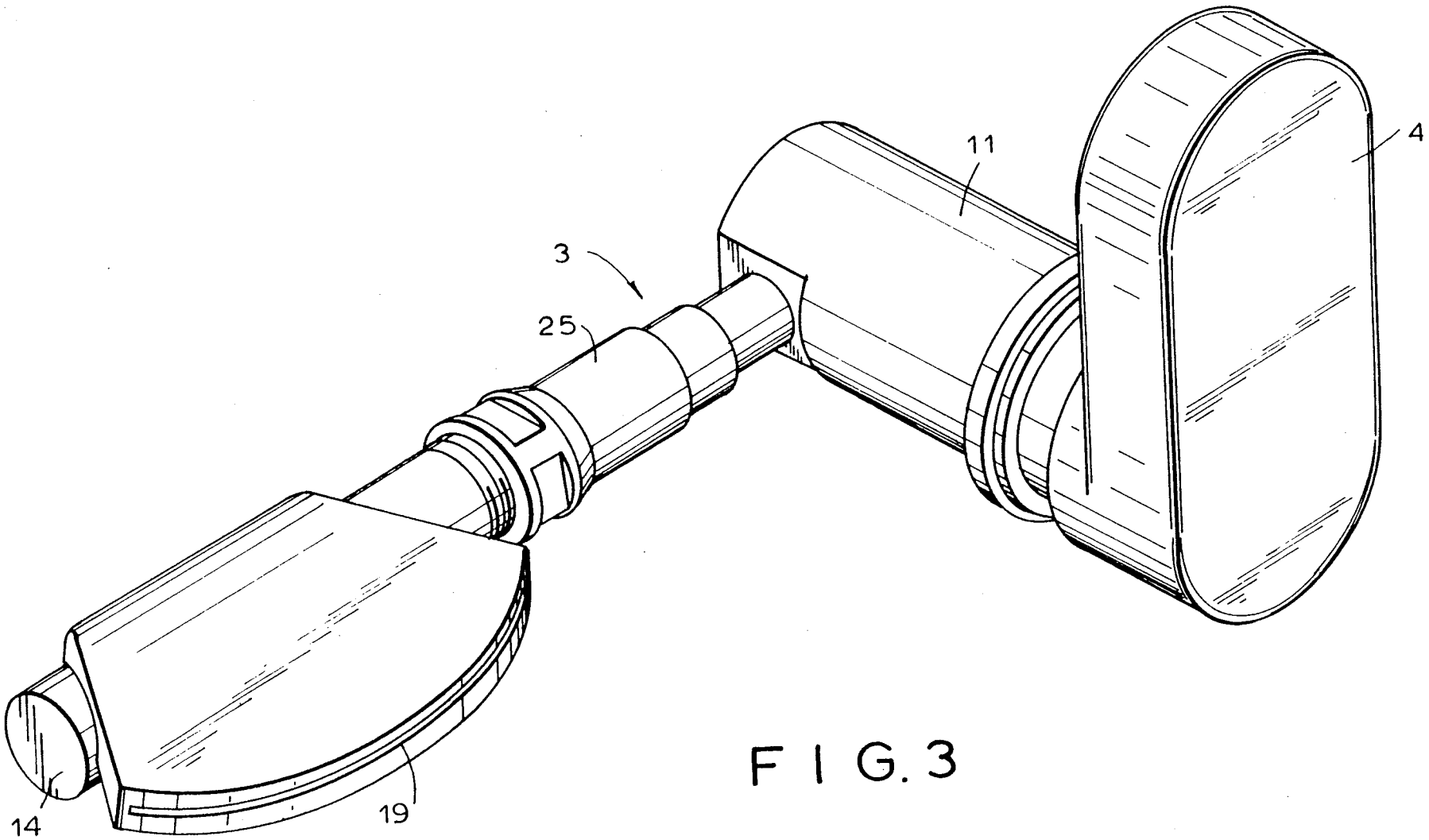
FIG. 3 is a perspective view of the sanitary fitting only.
Figure 4:
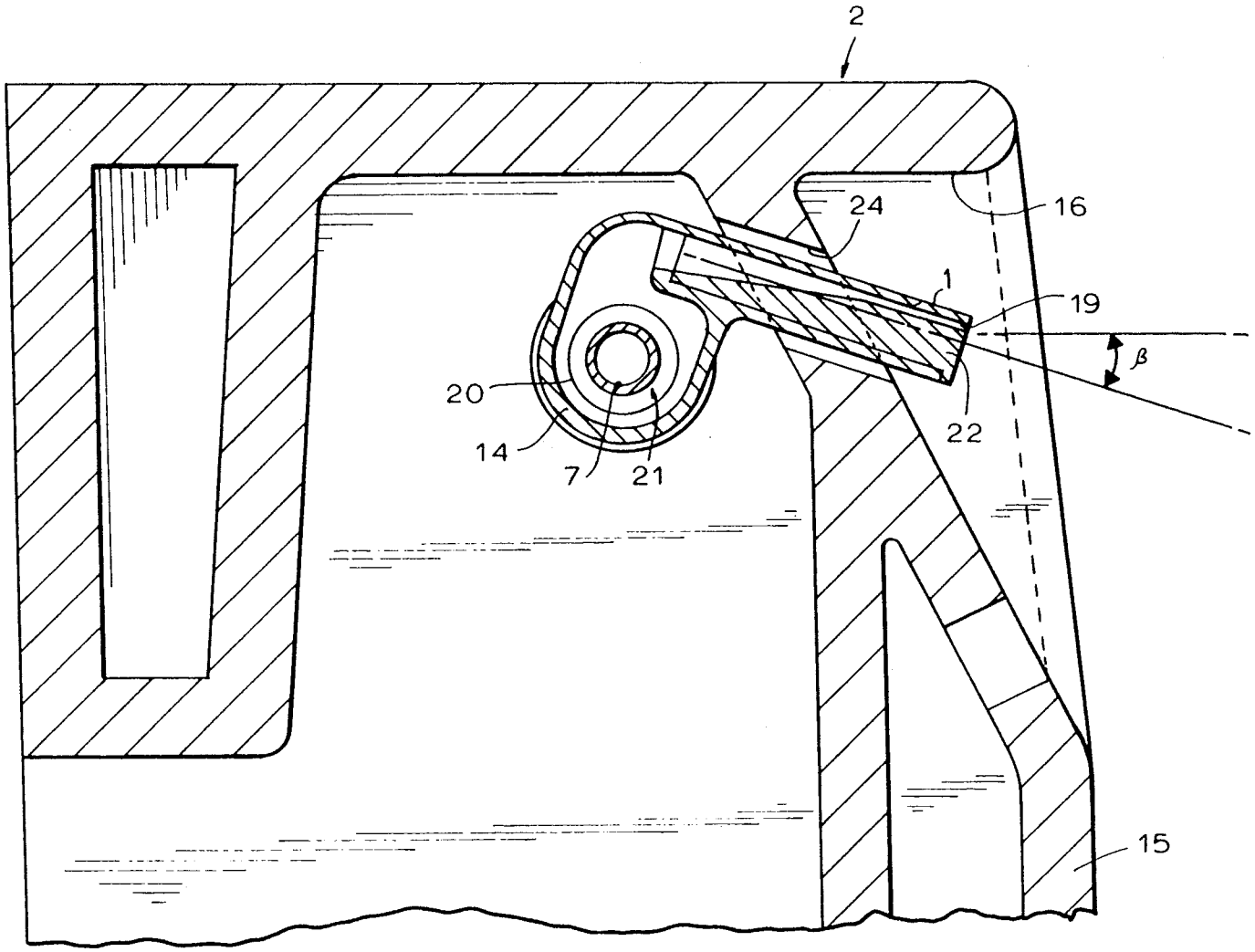
FIG. 4 is a sectional view, in elevation, taken along the lines 4—4 of FIG. 1.

FIG. 1 is a perspective view illustrating an integrated sanitary fitting 3 mounted to a lavatory 2. The mixture and the volume of water flow are regulated by handle 4 of sanitary fitting 3, shown in FIG. 3. FIG. 4 is a sectional view, in elevation, of sanitary fitting 3, including a spout 1 which is housed in recess 16 of wall 15 of lavatory 2. Spout 1 extends through opening 24, and is connected to tubular jacket 14. Tubular jacket 14 surrounds a distributor tube 7, whose outlet openings generally shown at 21 are situated in the lower area of tubular jacket 14 and are directed against it Distributor tube 7 is surrounded by a screen 20 so that at least some water discharging from distributor tube 7 passes through screen. 20 twice by first being forced downward through screen 20 and then upward through screen 20 again towards spout 1. A longitudinal slot 19 connects with the upper area of tubular jacket 14. The water then flows out from longitudinal slot 19 in a waterfall-like fashion.

Figure 5:
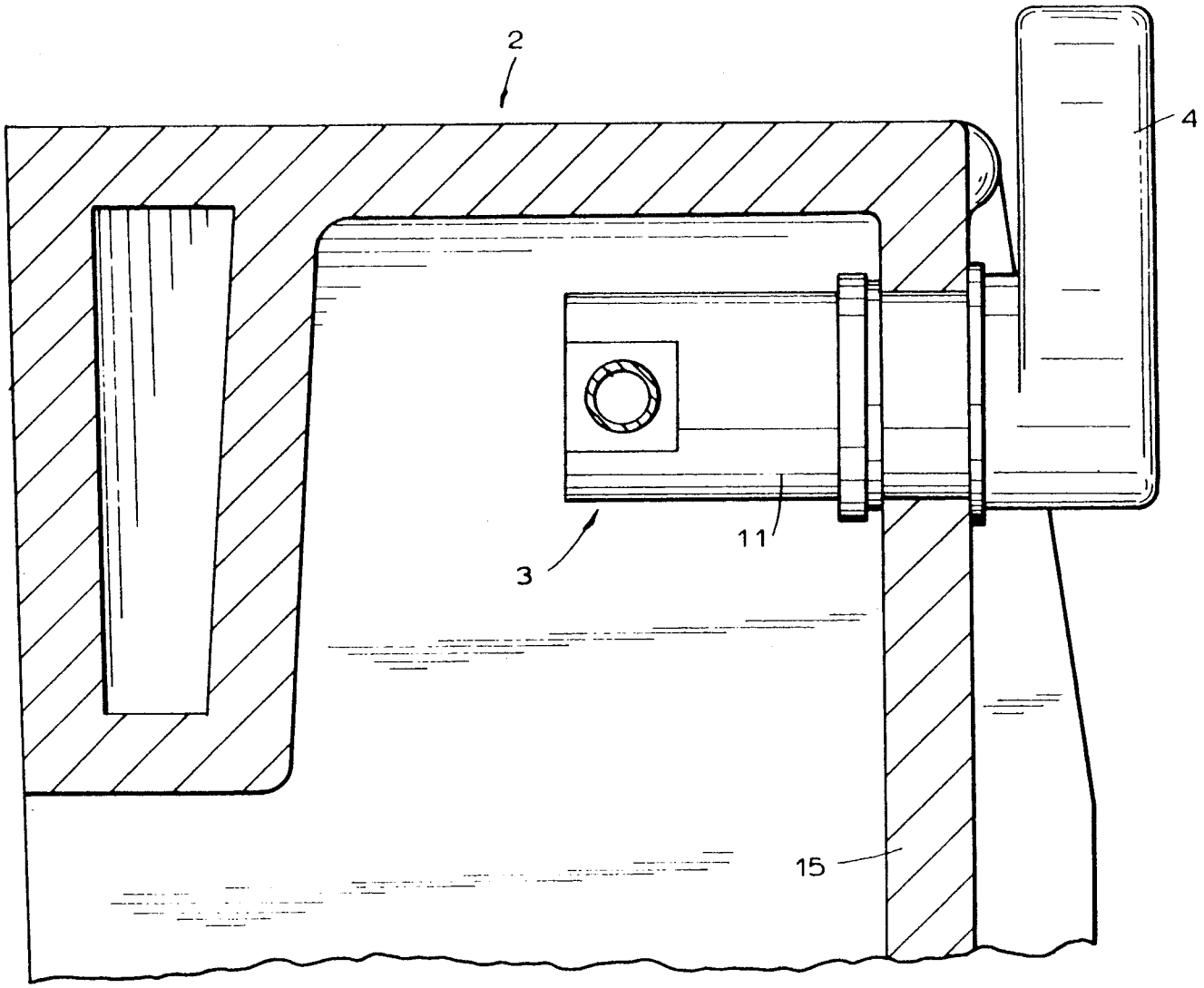
FIG. 5 is a fragmentary sectional view, in elevation, taken along the lines 5—5 of FIG. 1.
Figure 6:
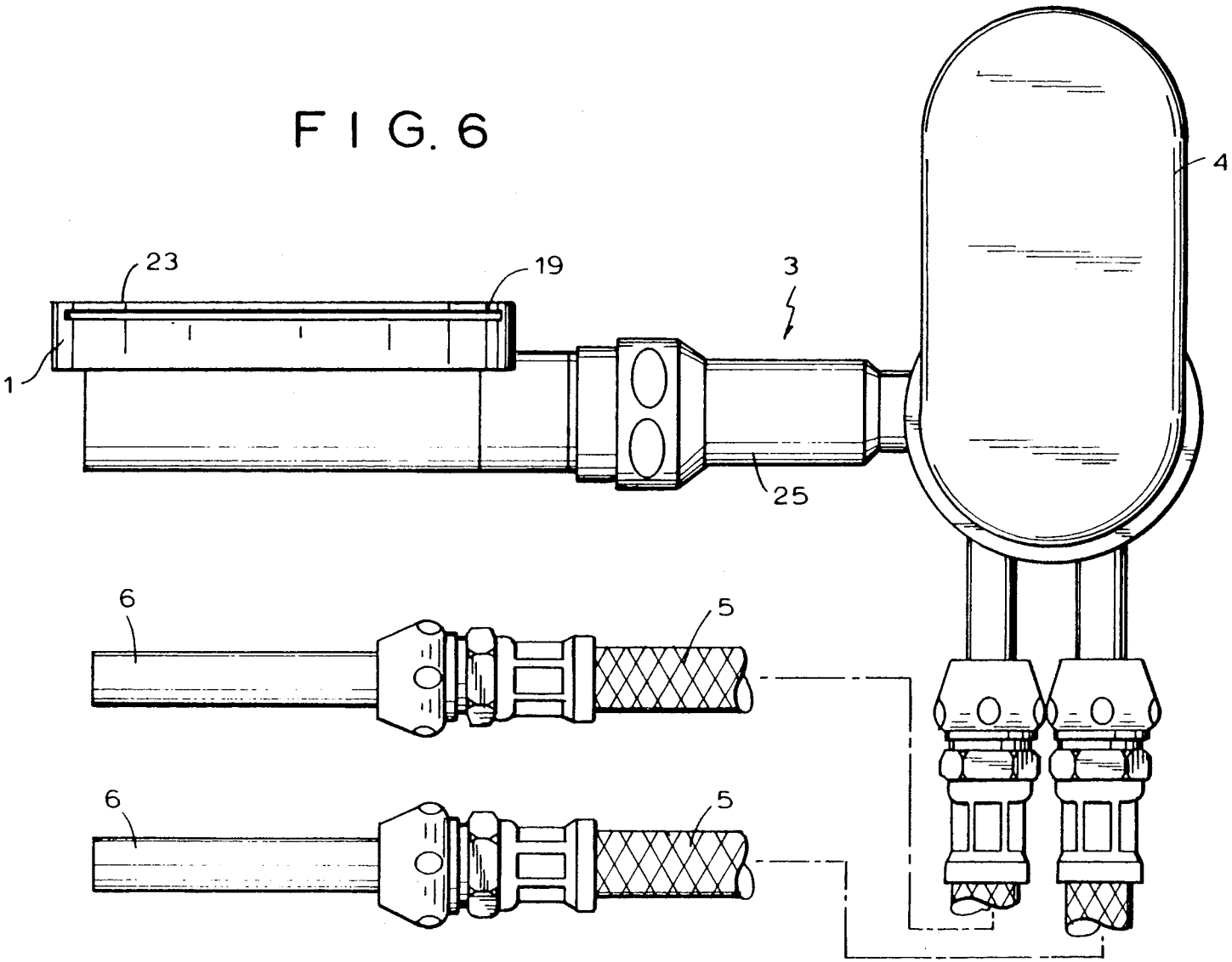
FIG. 6 is a front elevational view of the sanitary fitting with the sanitaryware broken away.

Sanitary fitting 3 can best be seen in FIGS. 4–6. The water supply is coupled to connecting tubes 6, to which hoses or conduits 5 are connected. Hoses 5 lead to sanitary fitting 3, which has a handle 4 and a housing 11. A valve cartridge 12, such as is shown in U.S. Pat. No. 3,433,264 of Parkison, with valving elements for mixing hot and cold water, is mounted in housing 11 of sanitary fitting 3.

Valving elements of valve cartridge 12 can have two ceramic discs, one of which is fixed and the other one movable. One disc includes ports for the inflow of cold and hot water and the outflow of mixed water, with the other disc having a mixing chamber. A rosette 10 and O-rings 17,18 are provided in the usual manner between operating lever 4 and housing 11. Also, shown in FIG. 6, is a securing nut 13 which mounts sanitary fitting 3 to lavatory 2. A connecting tube 25 is coupled to the water outlet of housing 11. Connecting tube 25 is coupled to distributor tube 7. At the transition between connecting tube 25 and distributor tube 7, the mixed water flows through a flow restrictor 8 and a filter or screen 9. Distributor tube 7 is coupled to waterfall spout 1 by adjustable jacket 14.

Distributor tube 7 is formed having a plurality of holes 21 for discharging mixed water therefrom. Since distributor tube 7 is surrounded by screen 20, the high flow rate of water is reduced Also, since distributor tube 7 is situated in the lower area of jacket 14 any air that may be present in the lower area of jacket 14 will be forced out of spout 1 and water discharged from spout 1 is non-turbulent.

Various inserts can be placed into waterfall spout 1. These facilitate an adaptation to the particular water quantities (bathtub or sink) by different slot heights which decrease in the flow direction, but they do not change the pattern of the jet. One possible waterflow for a slot height at the outlet end of spout 1, for example, may be 1.8 mm and at the opposite end of spout 1, 5.5 mm. Because of the decrease of the slot height, the flow rate remains constant.

Figure 7:
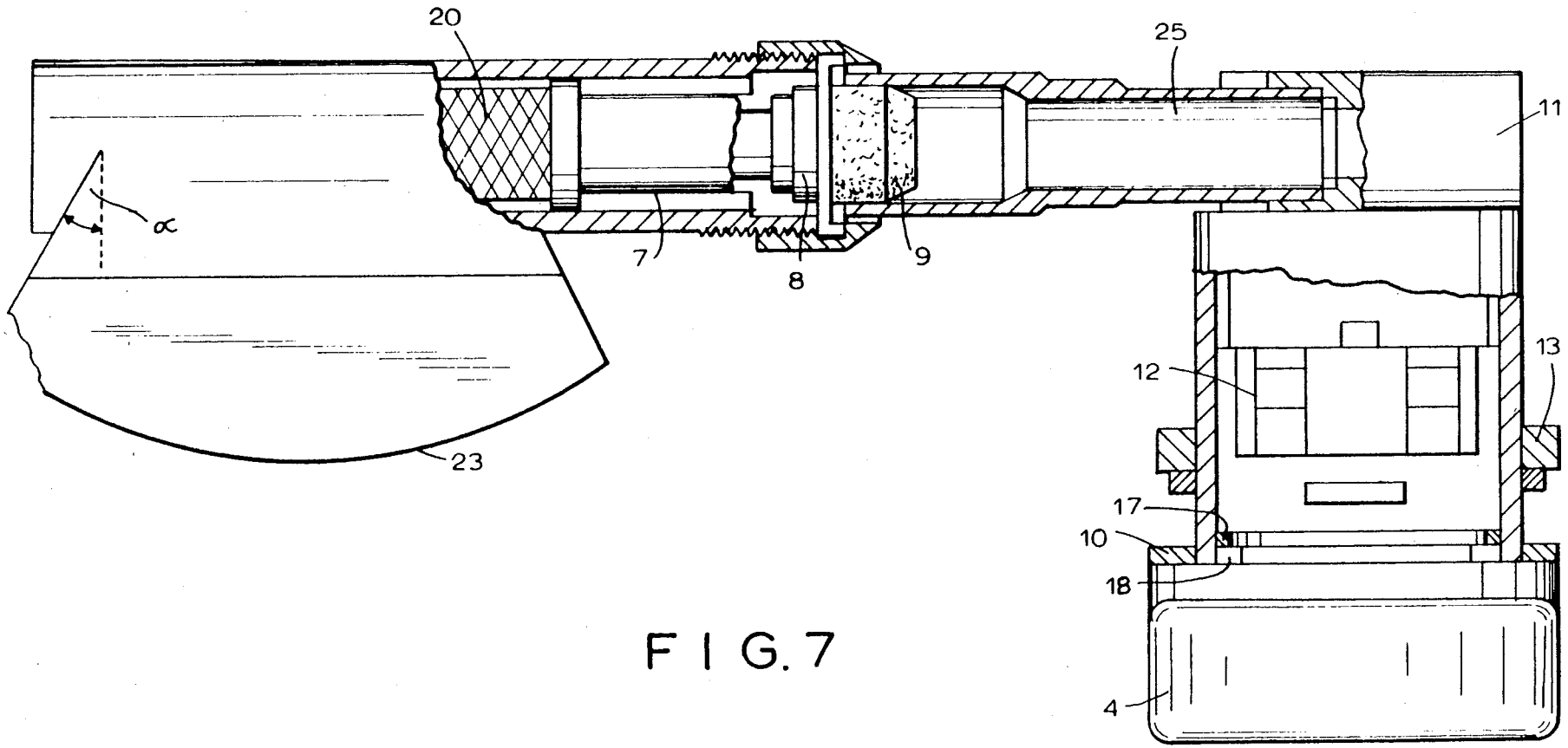
FIG. 7 is a top plan view of the sanitary fitting with portions thereof broken away.

The edges of waterfall spout 1 can be inclined at an angle, a=30° (FIG. 7), resulting in an opening angle of the waterfall spout ranging from 60° to 70°. Because the forward edge 23 of spout 1 preferably has a circular curvature, it is guaranteed that the gush of water rises in the middle and then propagates from there towards the ends. For example, a radius of about 80 mm at the outlet with a simultaneous downward slant of the outlet slot by about $\beta=15°$ (FIG. 4) prevents a backflow below the nozzle to the feed line. When small amounts of water are withdrawn, the run-out jets will migrate towards the middle of the slot.

It is possible to fabricate practically all parts from a suitable plastic material Further, it is possible to install a light source in the outlet slot or near the forward edge 23 so that the gush of water entering the basin of lavatory 2 is illuminated. The longitudinal slot 19 can be designed so that its walls are inclined to one another at an angle of about 5°. It is also possible for the walls, as shown in FIG. 4, to be initially inclined more towards one another and, then, in the last region, to be only slightly inclined to one another or to run even parallel.

It is claimed:

1. In combination, an integrated sanitary fixture and plumbing fitting, said fixture including a sanitary fixture wall having spaced apart recesses, a first recess in which the spout of said fitting is housed, and a second recess in which the valve actuating means for controlling hot and cold water discharged through the spout is housed:

a valve assembly coupled to said valve actuating means and having hot and cold water inlet openings and a discharge opening, a jacket having a bottom, a conduit coupled intermediate said discharge opening and said spout via said jacket, said conduit being positioned proximate the bottom of said jacket, said conduit having a lower portion, a screen surrounding said conduit for water discharge therethrough, said conduit having openings in the lower portion thereof to direct water towards the bottom of said jacket, said spout having generally upper and lower spaced apart planar surfaces having edges which diverge outwardly from said conduit and define an arcuate shaped end to form a longitudinal passage that defines a spout opening in said passage, and said spout having a pattern flow means varying in height which decreases in the flow direction toward the spout end, whereby a generally uniform rate of flow is maintained while the water pattern discharged at the spout end is in the form of a waterfall, said spout being inclined downwards at an angle of about 75 degrees with respect to the sanitary fixture wall.

2. The integrated sanitary fixture and plumbing fitting as claimed in claim 1, wherein the edges of the planar surfaces forming said spout form an angle between about 60° and 70° from a line normal to said conduit.

3. The integrated sanitary fixture and plumbing fitting as claimed in claim 1, wherein said pattern flow means varies in height from about 5.5 to about 1.8 mm.

4. The integrated sanitary fixture and plumbing fitting as claimed in claim 1, wherein said arcuate shaped end of said spout has a circular curvature having a radius of about 80 mm.

* * * * *